US008465312B2

(12) United States Patent
Di Stefano

(10) Patent No.: US 8,465,312 B2
(45) Date of Patent: Jun. 18, 2013

(54) SOCKET CARTRIDGE AND SOCKET CARTRIDGE ASSEMBLY

(75) Inventor: Thomas H. Di Stefano, Monte Sereno, CA (US)

(73) Assignee: Centipede Systems, Inc., San Jose, CA (US)

( * ) Notice: Subject to any disclaimer, the term of this patent is extended or adjusted under 35 U.S.C. 154(b) by 0 days.

(21) Appl. No.: 13/312,279

(22) Filed: Dec. 6, 2011

(65) Prior Publication Data

US 2012/0142210 A1 Jun. 7, 2012

Related U.S. Application Data

(60) Provisional application No. 61/420,733, filed on Dec. 7, 2010.

(51) Int. Cl.
*H01R 13/64* (2006.01)

(52) U.S. Cl.
USPC ..... 439/248

(58) Field of Classification Search
USPC ..... 439/247, 248
See application file for complete search history.

(56) References Cited

U.S. PATENT DOCUMENTS

| | | | | |
|---|---|---|---|---|
| 4,647,129 | A * | 3/1987 | Kandybowski et al. | 439/246 |
| 4,909,748 | A * | 3/1990 | Kozono et al. | 439/247 |
| 5,201,663 | A * | 4/1993 | Kikuchi et al. | 439/83 |
| 5,527,187 | A * | 6/1996 | Jurasek et al. | 439/247 |
| 5,758,776 | A | 6/1998 | Slocum et al. | |
| 6,159,030 | A * | 12/2000 | Gawron et al. | 439/247 |
| 7,083,453 | B2 * | 8/2006 | Herring et al. | 439/247 |
| 7,713,076 | B2 * | 5/2010 | Arts et al. | 439/248 |
| 8,210,861 | B2 * | 7/2012 | Tanis et al. | 439/248 |
| 2011/0294326 | A1 * | 12/2011 | Tanaka et al. | 439/248 |

* cited by examiner

*Primary Examiner* — Gary F. Paumen
(74) *Attorney, Agent, or Firm* — Michael B. Einschlag

(57) ABSTRACT

A socket cartridge including: a contactor holder adapted to hold one or more electrical contactors disposed therein; and one or more pairs of spring structures; wherein each spring structure (a) is attached at a proximal end to the contactor holder, (b) includes an engagement feature disposed at a distal end thereof and a spring member attached to the engagement feature, and (c) the spring member is adapted to urge the engagement feature in a direction that points outward from a distal end of the contactor holder. A socket assembly that includes: (a) a mounting plate having one or more pairs of mating guides disposed on opposite sides of an aperture; and (b) the socket cartridge disposed in the aperture.

7 Claims, 6 Drawing Sheets

SOCKET CARTRIDGE AND SOCKET CARTRIDGE ASSEMBLY

This patent application relates to U.S. Provisional Application No. 61/420,733 filed Dec. 7, 2010 from which priority is claimed under 35 USC §119(e), and which provisional application is incorporated herein in its entirety.

CROSS-REFERENCE TO RELATED APPLICATIONS

This application is related to the following application which is owned by the assignee of this application: a related application entitled "Carrier for Holding Microelectronic Devices," which related application has application Ser. No. 12/890,512 and was filed on Sep. 24, 2010.

TECHNICAL FIELD

One or more embodiments of the invention relate to a socket for an electronic device such as a microelectronic device, and more particularly to a socket cartridge and a socket cartridge assembly useful, for example and without limitation, for supplying power and electrical currents to microelectronic devices, for example, and without limitation, integrated circuits ("ICs").

BACKGROUND

Sockets are used widely in the electronics industry to mount and connect microelectronic devices such as semiconductor integrated circuits ("ICs") to electronics systems of various sorts—as is well known, a socket is used to connect terminals on a device to corresponding contacts on a printed circuit board or other electrical interconnection means. In addition, sockets are routinely used in systems for: (a) testing electronic device performance (an assortment of socket types have been developed to connect to a device under test ("DUT") having a wide variety of terminals and configurations); or (b) burn-in of electronic devices at elevated temperatures.

Prior art sockets are differentiated typically according to device terminals and intended end use (i.e., application). As such, sockets are typically designed to make electrical contact to microelectronic devices having specific types of device terminals—types of device terminals contacted by sockets include pin grid arrays ("PGAs"), J-leads, gull-wing leads, dual in-line ("DIP") leads, ball grid arrays ("BGAs"), column grid arrays ("CGAs"), flat metal pads ("LAN" grid arrays or "LGAs"), and many others. Many contactor technologies have been developed to provide sockets for microelectronic devices with this variety of terminals. In addition to the foregoing, further differentiation among prior art sockets refers to low insertion force ("LIF") sockets, zero insertion force ("ZIF") sockets, auto-load sockets, burn-in sockets, high performance test sockets, and production sockets (i.e., sockets for use in products). In further addition to the foregoing, low cost prior art sockets for burn-in and product applications typically incorporate contactors of stamped and formed springs to contact terminals on a DUT. In still further addition to the foregoing, for high pin-count prior art sockets, a cam is often used to urge device terminals laterally against corresponding contactors to make good contact to each spring while allowing a low or zero insertion force.

For specialized applications, prior art sockets have used a wide variety of contactors, including anisotropic conductive sheets, flat springs, lithographically formed springs, fuzz buttons (available from Cinch, Inc. of Lombard, Ill.), spring wires, barrel connectors, twisted wire springs in an elastomer, and spring forks, among others. Prior art sockets intended for applications where many test mating cycles (also referred to as socket mount-demount cycles) are required typically use spring pin contactors of the type exemplified by Pogo® spring contacts (available from Everett Charles Technologies of Pomona, Calif.). Spring probes for applications in the electronics test industry are available in many configurations, including simple pins and coaxially grounded pins. Most prior art spring probes consist of a helical wire spring disposed between a top post (for contacting terminals on the DUT) and a bottom post (for contacting contacts on a circuit board—a device under test board or "DUT board").

Prior art sockets typically consist of a plurality of contactors disposed in an array of apertures formed through a dielectric holder. By way of example, a high performance, prior art test socket may incorporate a plurality of Pogo® spring contacts, each of which is held in a pin holder consisting of an array of holes through a thin dielectric plate. The dielectric material in a high performance, prior art test socket is typically selected from a group of dimensionally stable polymer materials including: glass reinforced Torlon 5530 available from Quadrant Engineering Plastic Products, Inc. of Reading, Pa.; Vespel; Ultem 2000 available from GE Company GE Plastics of Pittsfield, Mass.; PEEK; liquid crystal polymer; and others. The individual Pogo® spring contacts are typically selected and designed for signal conduction at an impedance level of approximately fifty (50) ohms. In certain high performance, prior art configurations, the contactor is a coaxial type having a center spring pin with a contactor barrel body enclosed within a cylindrical, coaxial, ground shield spaced to achieve a desired signal impedance, typically fifty (50) ohms.

Materials other than the above-identified dielectric sheets have been used for prior art socket bodies. For example, ceramic materials including alumina, aluminum nitride, and low temperature co-fired ceramic are used for high temperatures. In addition, insulation coated, metal socket bodies have been used to control dimensional stability over a range of temperature. In further addition, laminated bodies of alternating layers of dielectric and metal materials in thermal contact with elastomeric contactors and compliant contactors have been used. Alignment of the contactors of a socket to the mating terminals of a DUT is an important function of a socket, particularly when the ambient temperature of the socket and mated DUT is changed over a wide range, which in modern usage may cover a range from −55° C. to +150° C.

Advances in ICs have resulted in devices with an increasing number of contact terminals, where the spacing between terminals continues to decrease. At present, terminals on packaged ICs have a minimum spacing on the order of 0.4 mm, where terminal density is projected to progress continually to smaller spacing and finer pitch. Advanced IC devices are typically tested in parallel, where several DUTs are tested simultaneously. DUTs are tested in parallel by an automatic handling system that inserts a number of devices into a corresponding array of sockets, at one time. Driven by demands for higher test efficiency, the number of DUTs tested in parallel is increasing from 8 in parallel to 16, 32 or more in the future. Advances in test technology result in smaller contact spacing, more parallel testing and wider ranges of test temperatures. These advances require more accurate alignment of arrays of sockets suited to contacting fine pitch DUTs over a wide temperature range.

In light of the above, despite the many socket technologies available in the prior art, there is a need for a socket that can resolve one or more of the above-identified issues relating to alignment accuracy of the socket to the mating DUT, and particularly to alignment of arrays of fine pitch DUTS to a mating array of sockets, where alignment must be held over a wide range of ambient temperatures.

SUMMARY

One or more embodiments of the invention resolve one or more of the above-identified issues. In particular, one embodiment is a socket cartridge useful to contact an electronic device, the socket cartridge comprising: a contactor holder adapted to hold one or more electrical contactors disposed therein; and one or more pairs of spring structures; wherein each spring structure (a) is attached at a proximal end to the contactor holder, (b) includes an engagement feature disposed at a distal end thereof and a spring member attached to the engagement feature, and (c) the spring member is adapted to urge the engagement feature in a direction that points outward from a distal end of the contactor holder. Another embodiment is a socket cartridge assembly useful to contact an electronic device, the socket assembly comprising: (a) a mounting plate having one or more pairs of mating guides disposed on opposite sides of an aperture; and (b) the socket cartridge disposed in the aperture.

DETAILED DESCRIPTION

Figure 1A:
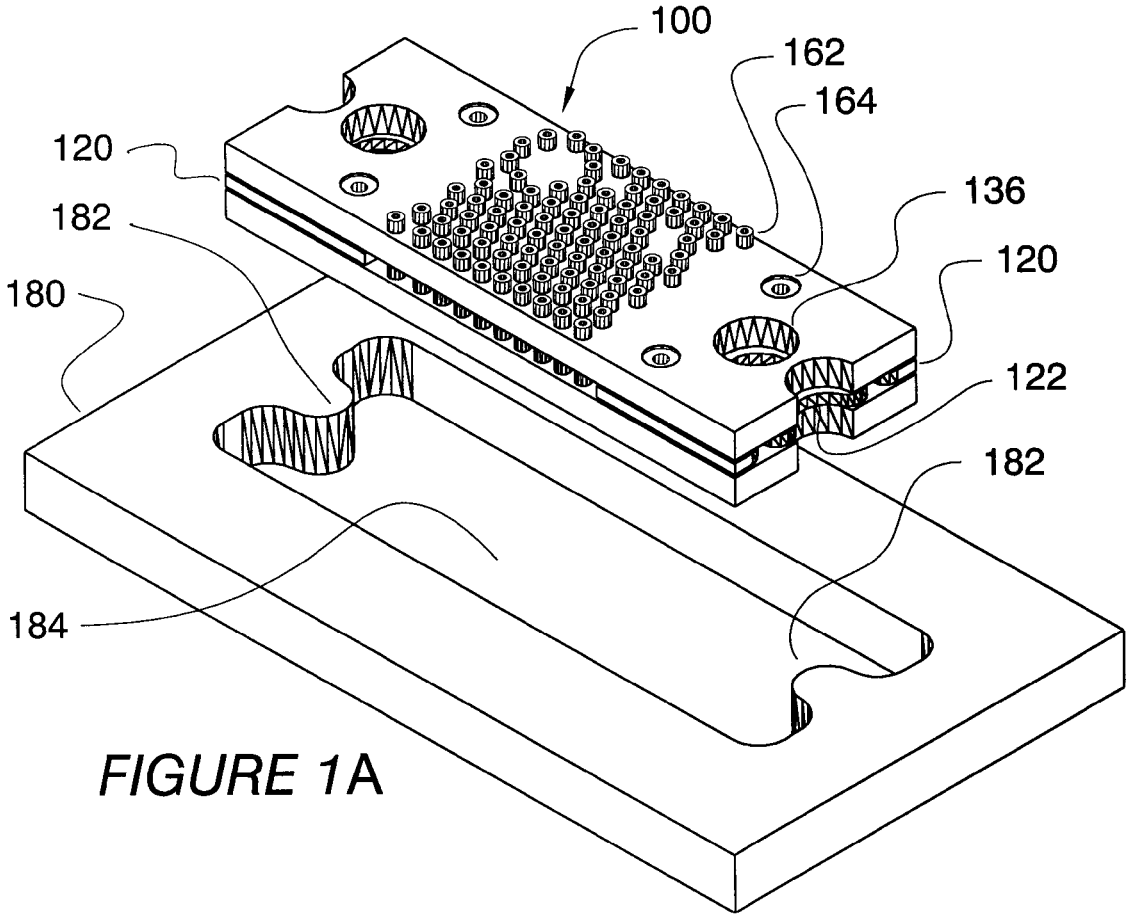
FIG. 1A shows a perspective view of a socket cartridge and a mounting plate that are fabricated in accordance with one or more embodiments.

FIG. 1A shows a perspective view of socket cartridge 100 that is fabricated in accordance with one or more embodiments. As shown in FIG. 1A, socket cartridge 100 is juxtaposed with mounting plate 180 that is adapted to hold socket cartridge 100 in precise alignment. In accordance with one or more embodiments, socket cartridge 100 can be used, among other things, as a socket for contacting an integrated circuit ("IC") or other microelectronic or electronic device.

Figure 2:
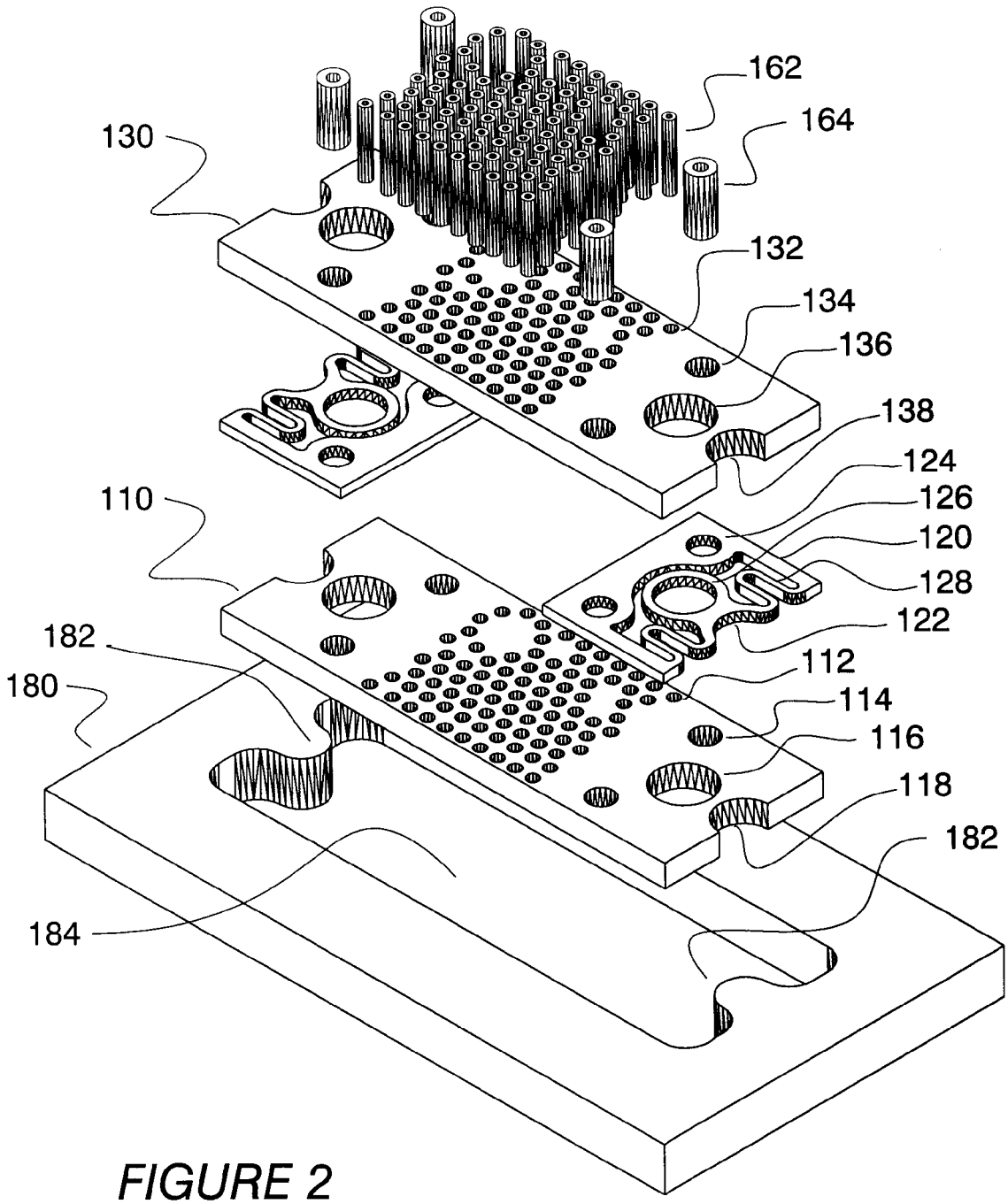
FIG. 2 shows an exploded perspective view of the socket cartridge and the mounting plate shown in FIGS. 1A and 1B.

As shown in the perspective view of FIG. 1A and in an exploded perspective view shown in FIG. 2, socket cartridge 100 comprises contactors, for example and without limitation, in the form of a plurality of spring probes 162 that are disposed in, for example and without limitation, circular, cylindrical through holes 132 and 112 in contactor holder plates 130 and 110 (refer to FIG. 2), respectively, of a contactor holder. In accordance with one or more such embodiments, one or more of spring probes 162 comprise an electrically conductive tube having slots through the tube at each end thereof, which slots extend (a) a predetermined distance away from each end; and (b) longitudinally in a direction substantially parallel to the tube axis. Further, in accordance with one or more such embodiments, a predetermined number of such slots are disposed about the tube circumference in a configuration that provides a slotted spring useful to engage contacts and/or terminals to which socket cartridge 100 may be connected. The number of slots, the arrangement of the slots about the circumference of a tube, and the length of the slots from each end of the tube may be determined routinely and without undue experimentation by one of ordinary skill in the art to provide a force suitable for connection to mating contact terminals on a device under test ("DUT").

Figure 1B:
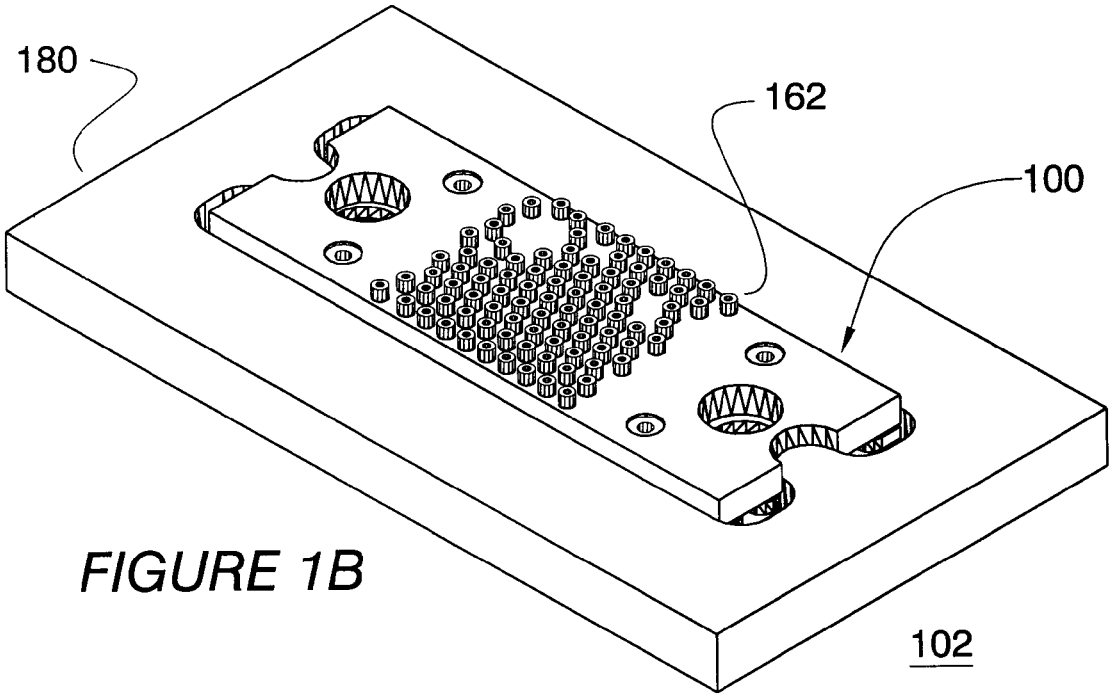
FIG. 1B shows a perspective view of the socket cartridge of FIG. 1A held in position in the mounting plate of FIG. 1A for use, for example and without limitation, for testing by providing a connection between a device under test ("DUT")—not shown—and a device under test board ("DUT board")—not shown.

Although the above-described embodiments may use the above-described spring probes, and they may also use contactors of the Pogo® spring contact type, it should be understood by one of ordinary skill in the art that this does not limit all embodiments to their use. Contactors such as, for example and without limitation, spring probes, that are suitable for use in fabricating one or more embodiments are available in many shapes and body diameters from suppliers such as, for example and without limitation, Everett Charles Technologies of Pomona Calif. ("Everett Charles"), Rika Denshi America of Attleboro Mass. ("Rika Denshi"), and Interconnect Devices, Inc. ("IDI") of Kansas City, Kans. In fact, further embodiments may be fabricated wherein other contactors are used such as, for example and without limitation, barrel springs available from Mill-Max Manufacturing Corp. of Oyster Bay, N.Y., contact springs, formed springs, and tubular connectors. It should also be understood by one of ordinary skill in the art that spring probes of many shapes and specifications may be used in place of the above-described Everett Charles spring probes. Lastly, it should be understood by one of ordinary skill in the art that the probes shown in FIGS. 1A, 1B and 2 are representations that are provided for purposes of simplifying the explanation of the various embodiments, and that they are not exact representations of any particular spring probes.

In accordance with one or more embodiments, socket cartridge 100 shown in FIG. 1A includes a pair of flat spring structures 120 that are disposed on opposing sides of socket cartridge 100 (the pair of flat spring structures 120 is readily seen in the exploded perspective view of FIG. 2). In accordance with one or more such embodiments, as shown in FIG. 2, each spring structure 120 includes an engagement feature 122 which: (a) is disposed at a distal end of each spring structure 120; and (b) is resiliently movable with respect to the distal end of spring structure 120 by flexure of a spring member comprised of spring elements 128. In accordance with one or more such embodiments, and as shown in FIG. 2: (a) engagement feature 122 includes a curved edge portion of the distal edge of spring structure 120 which extends into the body of spring structure 120 (i.e., a concave curved edge, for example and without limitation, a concave cylindrical edge); (b) each spring element 128 includes u-shaped elements that extend inward from the distal edge of spring element 128 where (i) one end of spring element 128 is affixed to a distal end of spring structure 120 and (ii) another end of spring element 128 is affixed to a distal end of the curved portion of engagement feature 122; and (c) one spring element 128 is disposed on each side of engagement feature 122.

In accordance with one or more such embodiments, and as indicated in FIG. 2, each spring structure 120 is attached at a proximal end to the contactor holder (i.e., in accordance with one or more such embodiments to contactor holder plates 110 and 130) by pins 164 projecting through holes 134, 124 and 114 in contactor holder plate 130, spring structure 120 and contactor holder plate 110, respectively. As further shown in FIG. 2, contactor holder plate 110 includes cutout features 118 which are disposed at, and which extend inward from, opposite ends, respectively, of contactor holder plate 110; and contactor holder plate 130 includes cutout features 138 which are disposed at, and which extend inward from, opposite ends, respectively, of contactor holder plate 130.

As can be understood by reference to FIG. 2, when each spring structure 120 is attached to contactor holder plates 110 and 130 of the contactor holder, engagement feature 122 of each spring structure 120: (a) is disposed to face outward from a distal end of contactor holder plates 110 and 130; and (b) is disposed to lie, at least in part, within cutout features 118 and 138. In addition, and as can also be understood by reference to FIG. 2, when each spring structure 120 is attached to contactor holder plates 110 and 130, engagement feature 122 disposed at a distal end of each spring structure 120 is resiliently movable with respect to contactor holder plates 110 and 130 (within cutout features 118 and 138) along a direction that points outward or inward from a distal end of the contactor holder by flexure of spring elements 128. As shown in FIG. 2, each spring structure 120 includes aperture 126 that is useful for coupling a movable portion of spring structure 120 (which movable portion includes engagement feature 122) with an actuating device such as, for example and without limitation, a rod or a pin. In accordance with one or more such embodiments, holes 116 and 136 in contactor holder plates 110 and 130, respectively, allow access of an actuating device to aperture 126 in spring structure 120.

Spring structure 120 is preferably fabricated as a sheet spring made, for example and without limitation, by etching or laser cutting a pattern in a sheet of 301 stainless steel. In accordance with one or more such embodiments, spring structure 120 is a sheet spring fabricated from a 0.2 mm thick sheet of 301 spring hard stainless steel.

As shown in FIG. 2, contactor holder plates 110 and 130 of the contactor holder are flat sheets and may be fabricated from sheets of, for example and without limitation, polyimide, Ultem, PEEK, or other dimensionally stable material. Further, in accordance with one or more such embodiments, contactor holder plates 110 and 130 may be fabricated from aramid fiber reinforced polyimide sheets having a thickness of about 0.5 mm. As will be understood by one of ordinary skill in the art, the number and configuration of the contactor holder plates may be adapted to provide a desired contactor holder. For example, one or more of the contactor plates may comprise several sheets. Further it should be understood by those of ordinary skill in the art that further embodiments exist wherein the contactor holder comprises only one contactor holder plate, for example, one of contactor holder plates 110 and 130, instead of both.

As shown in FIG. 2, mounting plate 180 is a flat sheet that includes aperture 184 and mating guides 182 that extend into aperture 184 from opposing ends of mounting plate 180. In accordance with one or more embodiments, mounting plate 180 may be fabricated from one or more sheets of, for example and without limitation, polyimide, Ultem, PEEK, or other dimensionally stable material. Further, in accordance with one or more such embodiments, mounting plate 180 may be fabricated from aramid fiber reinforced polyimide sheets having a thickness of about 0.5 mm.

As shown in FIG. 1B, socket assembly 102 is formed when socket cartridge 100 is held in aperture 184 of mounting plate 180. As can be understood by reference to FIG. 2, the array of contactors 162 is aligned accurately to mating guides 182 in socket assembly 102. As can also be understood by reference to FIG. 2, in socket assembly 102: (a) mating guides 182 of mounting plate 180 are disposed within cutout features 118 of contactor holder plate 110 and within cutout features 138 of contactor holder plate 130; and (b) spring elements 128 of spring structures 120 urge engagement features 122 of spring structures 120 outwardly from contactor holder plates 110 and 130 (in a direction that points outward from the distal ends of the contactor holder), and into contact with mating guides 182 in cutout features 118 and 138, thereby holding socket cartridge 100 in registration within aperture 184 of mounting plate 180.

Figure 3A:
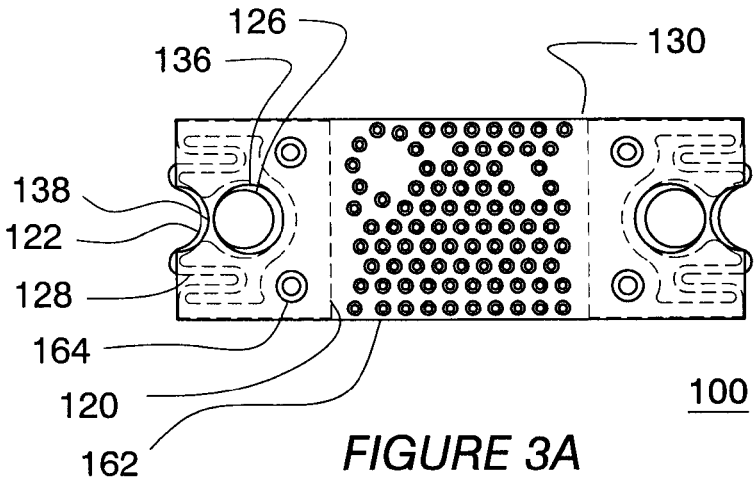
FIG. 3A shows a top view of the socket cartridge shown in FIGS. 1A and 1B.
Figure 3B:
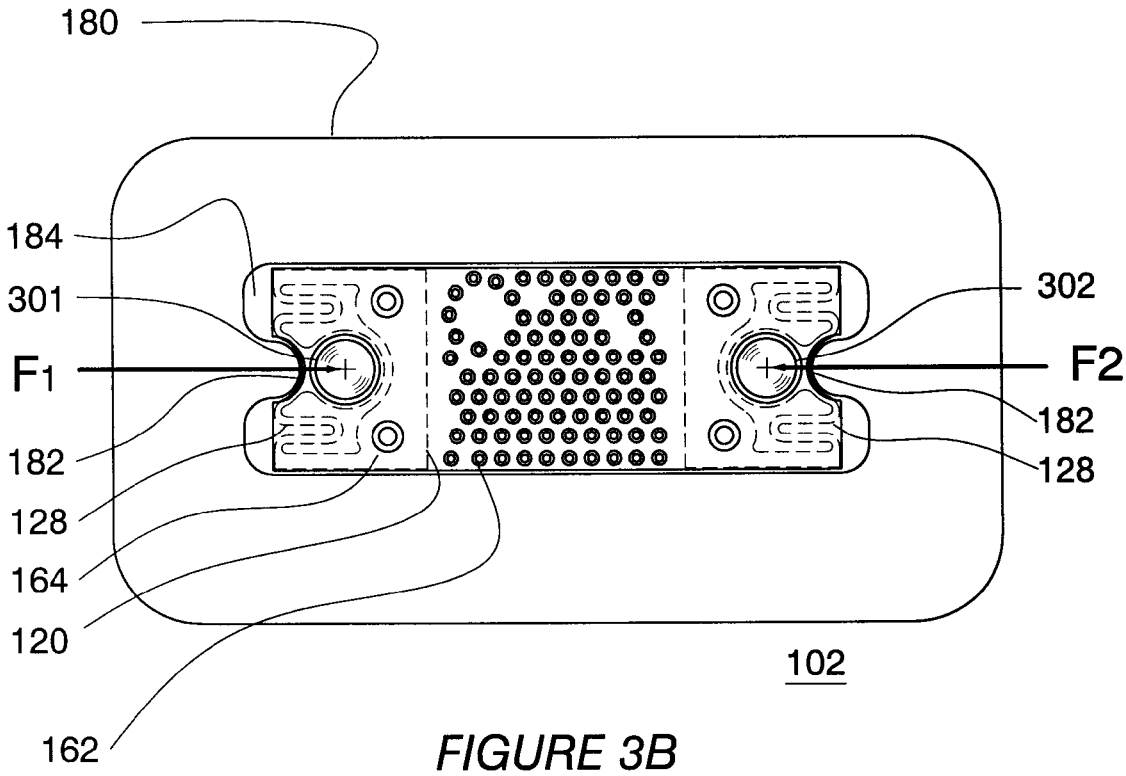
FIG. 3B shows a top view of the socket cartridge mated to the mounting plate shown in FIGS. 1A and 3A to illustrate how the socket cartridge and the mounting plate are mated in accordance with one or more embodiments.

FIG. 3A shows a top view of socket cartridge 100, and FIG. 3B shows a top view of socket cartridge 100 mated to mounting plate 180 to illustrate how socket cartridge 100 and mounting plate 180 are mated in accordance with one or more embodiments. As shown in FIG. 3A, engagement features 122 of spring structures 120 are seen protruding outwardly in a distal direction from contactor holder plate 130 and into cutout features 138. As further shown in FIG. 3A, apertures 126 in spring structures 120 are accessible through holes 136 in contactor holder plate 130.

As shown in FIG. 3B, to form socket assembly 102, socket cartridge 100 is inserted into aperture 184 of mounting plate 180 by first inserting pins 301 and 302 into apertures 126 in spring structures 120. Then, pins 301 and 302 are urged inwardly with respect to the distal ends of socket cartridge 100 by forces $F_1$ and $F_2$, respectively. This flexes spring elements 128 of the spring member and, thereby, moves engagement features 122 inwardly with respect to the distal ends of socket cartridge 100 to allow socket cartridge 100 to fit between mating guides 182 disposed on opposing sides of aperture 184 in mounting plate 180. Then socket cartridge 100 is inserted into aperture 184 with opposing engagement features 122 juxtaposed to mating guides 182 disposed on opposite sides of aperture 184. Then, forces $F_1$ and $F_2$ are relaxed, and pins 301 and 302 are removed from apertures 126. This allows spring elements 128 to urge engagement features 122 against the two opposing mating guides 182. As one of ordinary skill in the art can readily appreciate from this, spring elements 128 urge engagement features 122 (disposed on the distal ends of the two spring structures 120) against mating guides 182, and thereby, hold socket cartridge 100 in place and aligned to mounting plate 180. As one of ordinary skill in the art can readily further appreciate, socket cartridge 100 may be removed from socket assembly 102 by reversing the procedure described above.

Figure 4A:
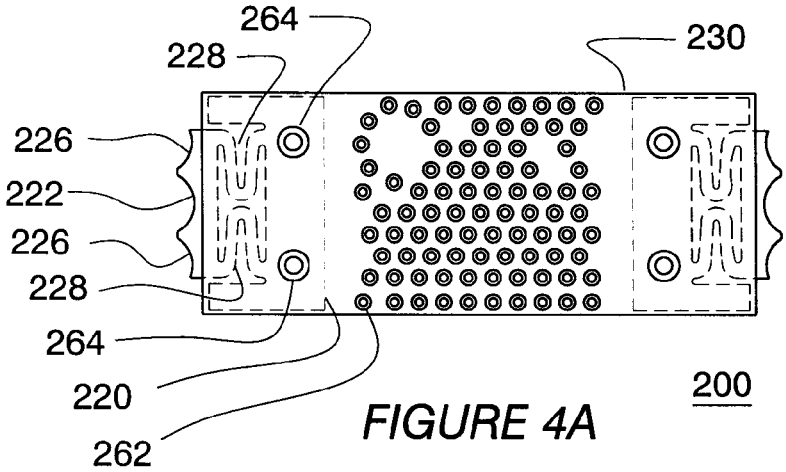
FIG. 4A shows a top view of a socket cartridge that is fabricated in accordance with one or more alternative embodiments.
Figure 4B:
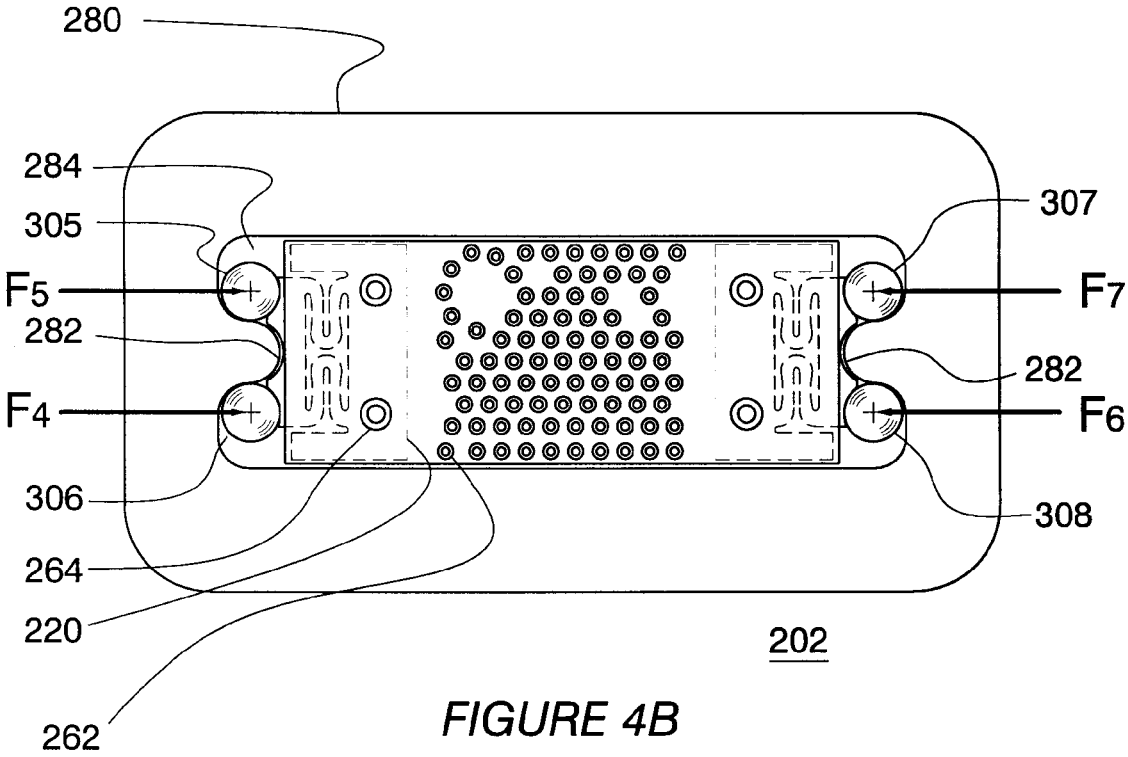
FIG. 4B shows a top view of the socket cartridge mated to a mounting plate which is fabricated in accordance with one or more alternative embodiments to illustrate how the socket cartridge and the mounting plate are mated in accordance with one or more alternative embodiments.

FIG. 4A shows a top view of socket cartridge 200 that is fabricated in accordance with one or more alternative embodiments, and FIG. 4B shows a top view of socket cartridge 200 mated to mounting plate 280 which is fabricated in accordance with one or more alternative embodiments to illustrate how socket cartridge 200 and mounting plate 280 are mated to form socket assembly 202 in accordance with one or more alternative embodiments. As shown in FIG. 4A, an array of contactors 262 is disposed in contactor holder plate 230. It should be understood that contactors 262 may be any one or more of the contactors described above as being suitable for fabricating contactors 162 above. As further shown in FIG. 4A, socket cartridge 200 includes a pair of spring structures 220 that are disposed on opposing ends of contactor holder plate 230, and each of spring structures 220 is attached to contactor holder plate 230 at a proximal end of each spring structure 230 by pins 264. In accordance with one or more such alternative embodiments, as shown in FIG. 4A, each spring structure 220 includes an engagement feature 222 which: (a) is disposed at a distal end of each spring structure 220; and (b) is resiliently movable with respect to the distal end of spring structure 220 by flexure of spring elements 228. In accordance with one or more such embodiments, and as shown in FIG. 4A, (a) engagement feature 222 includes a curved edge portion of the distal edge of spring structure 220 which extends into the body of spring structure 220 (i.e., a concave curved edge, for example and without limitation, a concave cylindrical edge); (b) the distal edge of spring structure 220 further includes couplers 226 which are disposed on either side of engagement feature 222, where each of couplers 226 includes a curved edge portion which extends into the body of spring structure 220 (i.e., a concave curved edge); (c) each spring element 228 includes u-shaped elements that extend parallel to the distal edge of spring structure 220 where (i) one end of spring element 228 is affixed to a proximal portion of spring structure 220 and (ii) another end of spring element 228 is affixed to an edge of engagement feature 222 opposite from its curved portion (i.e., opposite the distal edge of spring structure 220); and (d) one spring element 228 is disposed on either side of engagement feature 222. Contactor holder plate 230 and spring structures 220 may be fabricated in the manner described above with respect to contactor holder plates 110 and 130 and spring structure 120. In accordance with one or more further embodiments, engagement feature 222 is a triangular notch that extends inwardly from a distal edge of spring structure 220.

As can be understood by reference to FIG. 4A, when each spring structure 220 is attached to contactor holder plate 230, engagement feature 222 and couplers 226 of each spring structure 220 are disposed to face outward from an end of contactor holder plate 230. In addition, and as can also be understood by reference to FIG. 4A, when each spring structure 220 is attached to contactor holder plate 230, engagement feature 222 disposed at a distal end of each spring structure 220 is resiliently movable with respect to contactor holder plate 230.

As shown in FIG. 4B, mounting plate 280 is a flat sheet that includes aperture 284 and mating guides 282 that extend into aperture 284 from opposing ends of mounting plate 280. Mounting plate 280 may be fabricated in the same manner described above with respect to mounting plate 180.

As shown in FIG. 4B, socket assembly 202 is formed when socket cartridge 200 is inserted into aperture 284 in mounting plate 280. As shown in FIG. 4B, socket cartridge 200 is inserted into aperture 284 of mounting plate 280 by first disposing actuator pins 305, 306, 307 and 308 into contact with couplers 226 of spring structures 220. Then, actuator pins 305, 306, 307 and 308 are urged to apply forces $F_5$, $F_6$, $F_7$ and $F_8$, respectively, into couplers 226 to compress spring elements 228, thereby urging engagement features 222 at the distal ends of spring structures 220 with respect to the distal ends of socket cartridge 200. Then, socket cartridge 200 is inserted into aperture 284 with opposing engagement features 222 juxtaposed to mating guides 282 disposed on opposite sides of aperture 284. Then, forces $F_5$, $F_6$, $F_7$ and $F_8$ are relaxed to allow spring elements 228 to urge engagement features 222 against opposing mating guides 282, thereby holding socket cartridge 200 in place and aligned to mounting holder 280. Then, pins 305, 306, 307 and 308 are removed from aperture 284. As one of ordinary skill in the art can readily further appreciate, socket cartridge 200 may be removed from socket assembly 202 by reversing the procedure described above.

Figure 5:
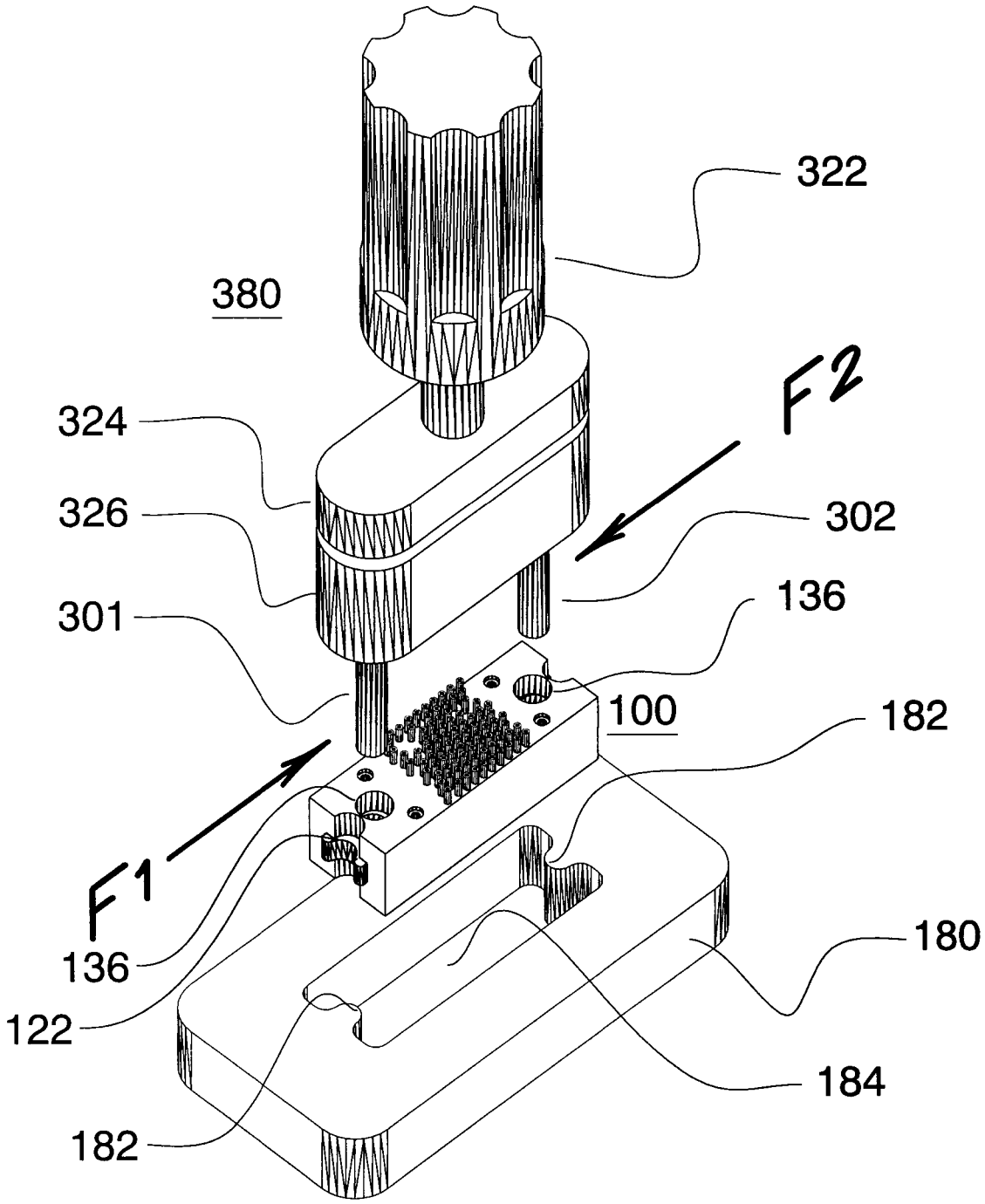
FIG. 5 shows a perspective view of the socket cartridge and the mounting plate shown in FIGS. 1A and 1B along with an insertion tool that is fabricated in accordance with one or more embodiments, which insertion tool may be used to mate the socket cartridge with the mounting plate.

FIG. 5 shows a perspective view of socket cartridge 100 and mounting plate 180 shown in FIGS. 1A and 1B, respectively, along with insertion tool 380 that is fabricated in accordance with one or more embodiments, which insertion tool is used to mate socket cartridge 100 with mounting plate 180. As shown in FIG. 5, actuator pins 301 and 302 are mounted to a body comprising mounting plate 324 and activating plate 326. In use, actuator pins 301 and 302 are inserted into holes 136 of socket cartridge 100 to actuate spring structures 120 (not shown in FIG. 5), and thereby, engagement features 122 disposed at distal ends of spring structures 120. Rotation of knob 322 in a first direction causes actuator pins 301 and 302 to move toward each other, and thereby, to exert forces $F_1$ and $F_2$ on spring structures 120. As a result, engagement features 122 are moved inwardly with respect to the distal ends of socket cartridge 100. This allows socket cartridge 100 to be inserted into aperture 184 between mating guides 182. Then, knob 322 is counter-rotated to cause pins 301 and 302 to move away from each other, and thereby, to release forces $F_1$ and $F_2$. In response, engagement features 122 are moved outwardly with respect to the distal ends of socket cartridge 100 to engage mating guides 182. As a result, socket cartridge 100 is held in registration in aperture 184. A structure within activating plate 326 that enables pins 310 and 302 to be moved towards and away from each other may be fabricated by one of ordinary skill in the art routinely and without undue experimentation using any one of a number of methods well known to those of ordinary skill in the art.

Figure 6A:
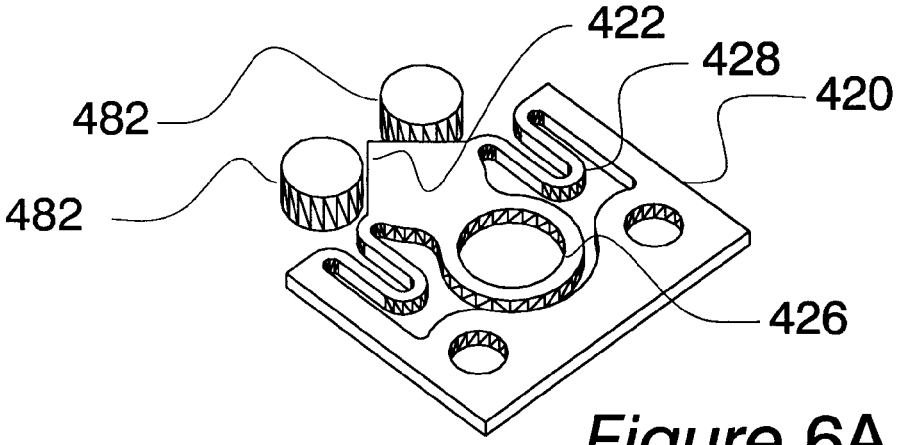
FIGS. 6A-6C show perspective views of retaining springs with engagement features and corresponding mating guides, where the retaining springs and the corresponding mating guides are fabricated in accordance with one or more embodiments.
Figure 6B:
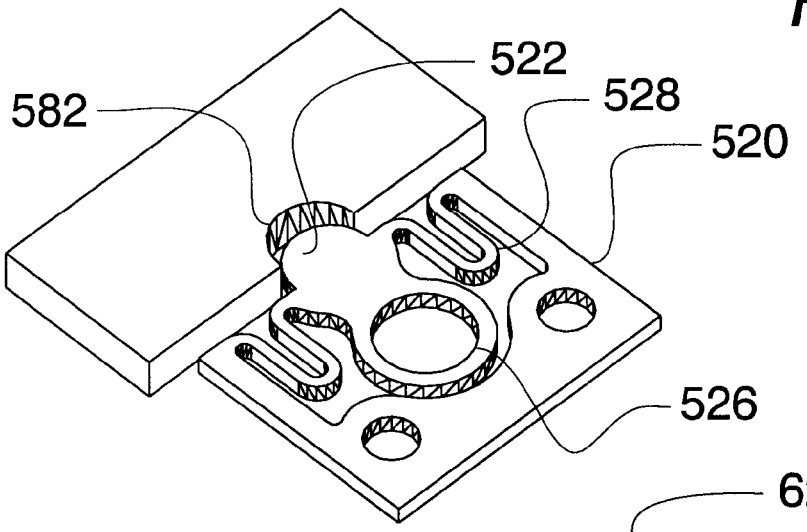
Figure 6C:
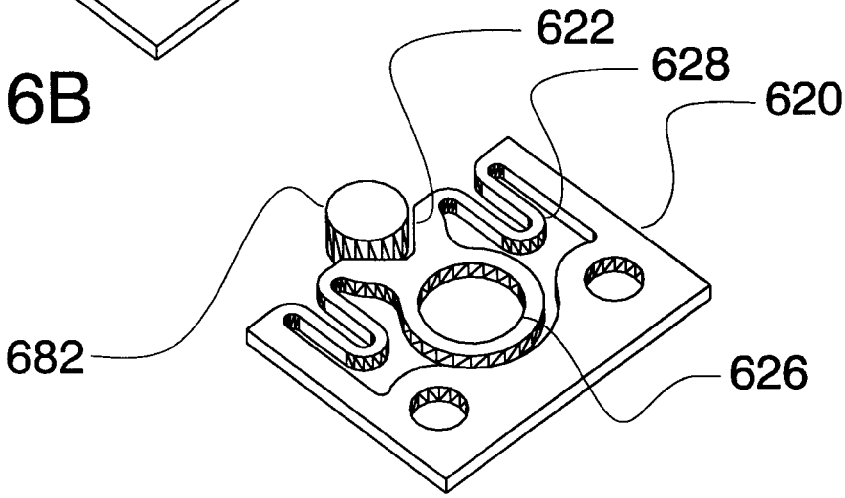

FIGS. 6A-6C show perspective views of spring structures with engagement features and corresponding mating guides, where the retaining springs and the corresponding mating guides are fabricated in accordance with one or more further embodiments. FIG. 6A shows a mating guide for use in fabricating a mounting plate in accordance with one or more embodiments, which mating guide is comprised of two cylinders 482, for example and without limitation, embedded in a supporting printed circuit board (not shown). As further shown in FIG. 6A, spring structure 420 is the same as spring structure 120 except for engagement feature 422. In accordance with one or more such embodiments, engagement feature 422 is a wedge that protrudes from a distal edge of spring structure 420. In addition, and as shown in FIG. 6A, wedge 422 engages the mating guide comprised of cylinders 482 by being positioned therebetween. In operation, wedge 422 is retracted in a direction away from the distal end of spring 420, for example and without limitation, by a pin inserted into hole 426. When left free, engagement feature 422 is urged outwardly in a direction that points along a direction outward from the distal edge of spring structure 420 by spring elements 428.

FIG. 6B shows mating guide 582 for use in fabricating a mounting plate in accordance with one or more embodiments, which mating guide 582 comprises concave indentation 582, for example and without limitation, a cylindrical concave indentation. As further shown in FIG. 6B, spring structure 520 is the same as spring structure 420 except for engagement feature 522. In accordance with one or more such embodiments, engagement feature 522 is boss 522 that protrudes from a distal edge of spring structure 520, for example and without limitation, a cylindrical boss. In addition, and as shown in FIG. 6B, boss 522 engages mating guide 582 by being positioned therein. In operation, boss 522 is retracted in a direction away from the distal end of spring 520, for example and without limitation, by a pin inserted into hole 526. When left free, engagement feature 522 is urged outwardly in a direction that points along a direction outward from the distal edge of spring structure 520 by spring elements 528.

FIG. 6C shows a mating guide for use in fabricating a mounting block in accordance with one or more embodiments, which mating guide is comprised of cylinder 682, for example and without limitation, disposed in a hole in a supporting printed circuit board (not shown). As further shown in FIG. 6C, spring structure 620 is the same as spring structure 120 except for engagement feature 622. In accordance with one or more such embodiments, engagement feature 422 is a triangular notch that extends inwardly from a distal edge of spring structure 620. In addition, and as shown in FIG. 6C, notch 622 engages mating guide 682 comprised of cylinder 682 by being positioned in contact therewith. In operation, wedge 622 is retracted in a direction away from the distal end of spring 620, for example and without limitation, by a pin inserted into hole 626. When left free, engagement feature 622 is urged outwardly in a direction that points along a direction outward from the distal edge of spring structure 620 by spring elements 628.

It should be understood that although the embodiments discussed utilize two mating guides for a mounting plate, further embodiments exist where a larger number of mating guides may exist, and they may be disposed on more than two opposing edges thereof. Similarly, further embodiments exist where a spring member of a spring structure includes only one or more than two springs. Similarly, further embodiments exist where spring structures may be affixed to more than two opposing ends of a contactor holder. Similarly, further embodiments exist wherein different embodiments of mating guides and different embodiments of spring structures are used to fabricate a socket structure and mounting plates.

As one of ordinary skill in the art will readily appreciate, sockets fabricated in accordance with one or more embodiments may include any number of seals, retaining elements, gaskets, adhesives, washers, or other elements that function to hold contactors 162 in registration and alignment.

Embodiments described above are exemplary. As such, many changes and modifications may be made to the description set forth above by those of ordinary skill in the art while remaining within the scope of the invention. In addition, materials, methods, and mechanisms suitable for fabricating embodiments have been described above by providing specific, non-limiting examples and/or by relying on the knowledge of one of ordinary skill in the art. Materials, methods, and mechanisms suitable for fabricating various embodiments or portions of various embodiments described above have not been repeated, for sake of brevity, wherever it should be well understood by those of ordinary skill in the art that the various embodiments or portions of the various embodiments could be fabricated utilizing the same or similar previously described materials, methods or mechanisms. As such, the scope of the invention should be determined with reference to the appended claims along with their full scope of equivalents.

What is claimed is:

1. A socket cartridge that comprises:

a contactor holder adapted to hold one or more electrical contactors disposed therein; and one or more pairs of flat spring structures;

wherein each flat spring structure (a) is attached at a proximal end to the contactor holder, (b) includes an engagement feature disposed at a distal end thereof and a spring member attached to the engagement feature, and (c) the spring member is adapted to urge the engagement feature in a direction that points outward from a distal end of the contactor holder;

wherein the spring member comprises spring elements disposed on opposite sides of the engagement feature, and each of the spring elements are affixed to a distal end of the spring structure and to a distal end of the engagement feature; and wherein the engagement feature includes a concave surface on the distal edge of the flat spring structure.

2. A socket cartridge that comprises:

a contactor holder adapted to hold one or more electrical contactors disposed therein; and one or more pairs of flat spring structures;

wherein each flat spring structure (a) is attached at a proximal end to the contactor holder, (b) includes an engagement feature disposed at a distal end thereof and a spring member attached to the engagement feature, and (c) the spring member is adapted to urge the engagement feature in a direction that points outward from a distal end of the contactor holder;

wherein the spring member comprises spring elements disposed on opposite sides of the engagement feature, and each of the spring elements are affixed to a distal end of the spring structure and to a distal end of the engagement feature; and wherein the engagement feature is a convex boss extending from the distal edge of the flat spring structure.

3. A socket cartridge that comprises:

a contactor holder adapted to hold one or more electrical contactors disposed therein; and one or more pairs of flat spring structures;

wherein each flat spring structure (a) is attached at a proximal end to the contactor holder, (b) includes an engagement feature disposed at a distal end thereof and a spring member attached to the engagement feature, and (c) the spring member is adapted to urge the engagement feature in a direction that points outward from a distal end of the contactor holder;

wherein the spring member comprises spring elements disposed on opposite sides of the engagement feature, and each of the spring elements are affixed to a distal end of the spring structure and to a distal end of the engagement feature; and wherein the engagement feature is a wedge protruding from the distal edge of the flat spring structure.

4. A socket cartridge that comprises:

a contactor holder adapted to hold one or more electrical contactors disposed therein; and one or more pairs of flat spring structures;

wherein each flat spring structure (a) is attached at a proximal end to the contactor holder, (b) includes an engagement feature disposed at a distal end thereof and a spring member attached to the engagement feature, and (c) the spring member is adapted to urge the engagement feature in a direction that points outward from a distal end of the contactor holder;

wherein the spring member comprises spring elements affixed on opposite sides of the engagement feature, each of the spring elements being affixed to a proximal end of the spring structure and to an edge of the engagement feature opposite a distal edge of the spring structure; and wherein the engagement feature is a notch into the distal edge of the flat spring structure.

5. A socket cartridge that comprises:

a contactor holder adapted to hold one or more electrical contactors disposed therein; and one or more pairs of flat spring structures;

wherein each flat spring structure (a) is attached at a proximal end to the contactor holder, (b) includes an engagement feature disposed at a distal end thereof and a spring member attached to the engagement feature, and (c) the spring member is adapted to urge the engagement feature in a direction that points outward from a distal end of the contactor holder;

wherein the spring member comprises spring elements affixed on opposite sides of the engagement feature, each of the spring elements being affixed to a proximal end of the spring structure and to an edge of the engagement feature opposite a distal edge of the spring structure; and wherein the engagement feature includes an engagement concave surface on the distal edge of the flat spring structure disposed between couplers.

6. The socket cartridge of claim 5 wherein each coupler is a concave surface on the distal edge of the flat spring structure.

7. The socket cartridge of claim 5 wherein the engagement concave surface is a notch.

* * * * *